United States Patent [19]

Graham

[11] 4,455,705

[45] Jun. 26, 1984

[54] CLEANING DEVICE

[75] Inventor: John W. Graham, Simpsonville, S.C.

[73] Assignee: Swiss-Tex Incorporated, Piedmont, S.C.

[21] Appl. No.: 411,463

[22] Filed: Aug. 25, 1982

[51] Int. Cl.[3] ..... A47L 1/06

[52] U.S. Cl. ..... 15/121; 15/144 R; 15/230.17; 15/244 A

[58] Field of Search ..... 15/144 R, 147 R, 147 A, 15/209 R, 209 D, 210 R, 167 R, 230.17, 118, 121

[56] References Cited

U.S. PATENT DOCUMENTS

| | | | |
|---|---|---|---|
| 3,005,219 | 10/1961 | Miller | 15/118 X |
| 3,302,232 | 2/1967 | Wasiloff et al. | 15/230.17 |
| 3,395,416 | 8/1968 | Hughes | 15/144 R X |
| 3,527,001 | 9/1970 | Kleemeier et al. | 15/230.17 |
| 3,590,414 | 7/1971 | Gores | 15/167 R X |
| 4,059,864 | 11/1977 | Spresny | 15/244 A |
| 4,282,623 | 8/1981 | Gacuzana | 15/230.17 |
| 4,380,092 | 4/1983 | Brothers | 15/230.17 |

FOREIGN PATENT DOCUMENTS

| | | | |
|---|---|---|---|
| 489640 | 10/1918 | France | 15/167 R |

*Primary Examiner*—Edward L. Roberts

*Attorney, Agent, or Firm*—Bell, Seltzer, Park & Gibson

[57] ABSTRACT

Integrally molded impaling spikes are positioned in aligned longitudinally and transversely extending rows throughout substantially one side of an applicator head. A cleaning component is provided with a layer of fibers to be penetrated and engaged by the impaling spikes when the cleaning component is pressed against the applicator head so that lateral movement of the cleaning component is prevented during use of the cleaning device. The cleaning component may be easily stripped from the applicator head for replacement by another cleaning component.

9 Claims, 7 Drawing Figures

CLEANING DEVICE

FIELD OF THE INVENTION

The present invention relates generally to a cleaning device for windows and the like which includes an easily removable and replaceable cleaning element, such as a spongelike pad or the like.

BACKGROUND OF THE INVENTION

It is generally known to provide various types of cleaning devices with removable and replaceable cleaning elements, such as a sponge or the like. However, the removal and replacement of these known types of cleaning elements usually requires removal and replacement of the attachment means, such as threaded nuts, bolts and the like. The attachment means may become corroded in use and may require special tools to remove and replace the attachment means.

In an attempt to overcome the problems associated with the removal and replacement of the cleaning element, U.S. Pat. No. 3,299,462 discloses a cleaning device in which an elongate sponge-type cleaning element is held in position by sharp tips integrally molded with opposed end portions of a support member. The sharp tips slant outwardly toward the respective ends of the support member and penetrate into each end portion of one side of the cleaning sponge. The sponge is attached to the support member by longitudinally stretching the sponge and hooking it at each end over the oppositely slanting sharp tips so that the sponge is held at opposite ends of the support member and is maintained under tension in the medial area extending between the slanting sharp tips at opposite ends of the support member.

While the cleaning element of the device of this patent can be easily removed and replaced, only the outermost portions of the cleaning element are securely attached to the support member and the central portion of the cleaning element is not secured against lateral movement during use. Also, the longitudinal tension on the cleaning element may adversely affect the liquid absorption and cleaning characteristics of the cleaning element.

SUMMARY OF THE INVENTION

With the foregoing in mind, it is an object of the present invention to provide a cleaning device having an easily removable and replaceable cleaning component or element and which includes an applicator head with male fastening means in the form of spaced-apart impaling spikes or points integrally molded with and positioned substantially throughout one side of the applicator head. The free ends of the impaling spikes are provided with outwardly extending burrs which penetrate and engage a layer of fibers on one side of the cleaning component when the cleaning component is pressed thereagainst. The impaling spikes securely hold the cleaning component in position and prevent lateral movement of the cleaning component throughout substantially the full length of the cleaning component during use of the cleaning device. The impaling spikes also permit the cleaning component to be easily stripped from the applicator head for replacement.

The applicator head of the present cleaning device is preferably rectangular and a squeegee blade is supported on and extends outwardly from one of the longer side edges of the applicator head. An elongate handle is pivotally supported at one end on the applicator head and stop means is provided in the pivotal support for limiting the pivotal movement of the applicator head relative to the handle so that the squeegee blade is in the proper angular position when the squeegee blade is to be engaged with the surface being cleaned. Both the applicator head and the elongate handle are preferably formed of molded plastic material.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figures 1, 2, 3, 4, 5, 6, 7:
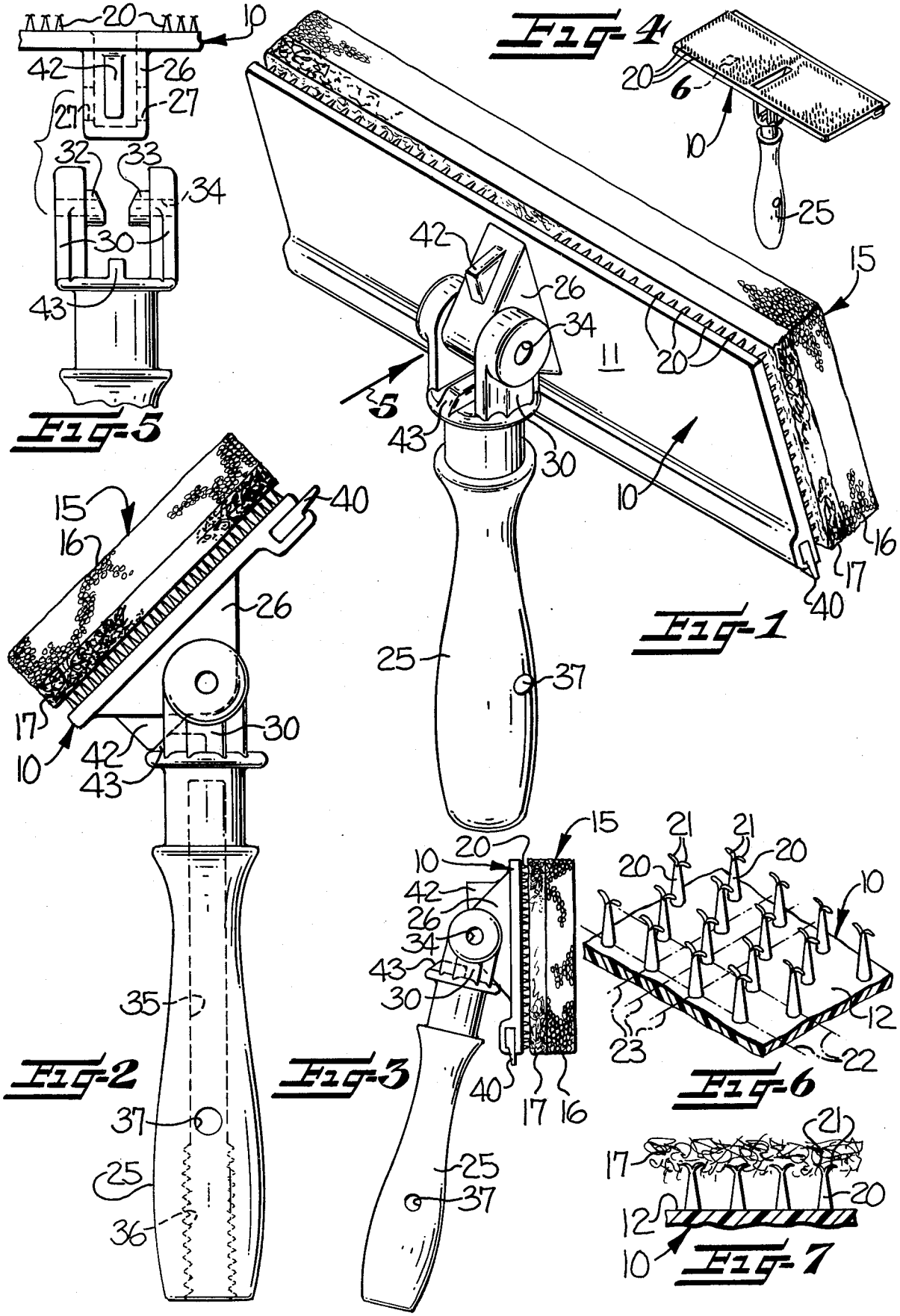
FIG. 1 is an isometric view of the present cleaning device with the applicator head being pivoted to one position on the handle.
FIG. 2 is an end elevational view of the cleaning device with the applicator head being pivoted to the opposite position on the handle.
FIG. 3 is a view similar to FIG. 2, at a reduced scale, and illustrating the applicator head pivoted to the position shown in FIG. 1.
FIG. 4 is an isometric view of the cleaning device with the cleaning component removed to show the location of the spaced-apart impaling spikes on one side of the applicator head.
FIG. 5 is a fragmentary elevational view with the parts in exploded position and looking in the direction of the arrow 5 in FIG. 1.
FIG. 6 is an enlarged fragmentary isometric view of a small area of the applicator head, being taken substantially in the area 6 of FIG. 4, and illustrating the arrangement and appearance of the impaling spikes.
FIG. 7 is a vertical sectional view illustrating the manner in which the impaling spikes penetrate and engage the fibers provided on one side of the cleaning component.

The cleaning device of the present invention includes a molded plastic applicator head, broadly indicated at 10, including opposed respective outer and inner sides 11, 12. The applicator head 10 is preferably rectangular and is illustrated as being eight inches long and three and one-quarter inches wide so that the length is about two and one-half times the width. A cleaning component or element, broadly indicated at 15, is of generally the same configuration as the inner side 12 of the applicator head 10. The cleaning component 15 includes a cleaning pad 16 which is preferably formed of spongelike material, such as prepolymer polyester urethane.

The outer side of the cleaning pad 16 is preferably provided with a "waffle" configuration including a series of raised and depressed areas. It has been found that this type of surface provides enhanced cleaning characteristics to the cleaning pad 16. The other side of the cleaning component 15 is provided with female fastening means extending substantially throughout the inside surface of the cleaning pad 16. The female fastening means is illustrated as a nonwoven layer of polyester fibers, indicated at 17, which is adhesively secured to the cleaning pad 16. The layer of nonwoven fibers is formed by randomly arranging the fibers in a layer and applying a binding material thereto so that the fibers are adhered to each other at their crossovers.

Male fastening means is provided on the inner side 12 of the applicator head 10 and includes a plurality of generally conical-shaped impaling spikes or points 20 extending outwardly from and extending over a major portion of the inner side 12 of the applicator head 10. The inner or larger ends of the impaling spikes 20 are integrally molded with the applicator head 10 and the outer free end portions thereof are provided with attaching means for penetrating engagement with the layer of fibers 17 on the cleaning pad 16. The attaching means on the end portions of the impaling spikes 20 is illustrated (FIGS. 6 and 7) as including a pair of burrs integrally molded with the smaller outer ends of each of the impaling spikes 20. The burrs 21 extend outwardly in opposite directions from and at substantially right angles to the longitudinal axis of each of the impaling spikes 20.

The impaling spikes 20 are arranged in aligned longitudinally extending rows, indicated by the dash-dot lines 22 in FIG. 6, and in aligned transversely extending rows, indicated by the dash-dot lines 23 in FIG. 6. As shown, the spikes 20 in adjacent longitudinal rows 22 are staggered or offset relative to each other. The distance between adjacent impaling spikes 20 in the longitudinal and transverse rows 22, 23 is substantially equal to the length of the impaling spikes 20.

When the inner surface of the cleaning component 15 is pressed against the inner side 12 of the applicator head 10, the impaling spikes 20 penetrate the layer of fibers 17 and the burrs 21 engage and become entangled with the layer of fibers 17, as illustrated in FIG. 7. Since the impaling spikes 20 are arranged substantially throughout the entire area of the applicator head 10, the impaling spikes 20 prevent lateral movement throughout the length and width of the cleaning component 15 during use of the cleaning device. Thus, the cleaning component 15 may be easily secured in position on the applicator head 10 by merely pressing one side thereof against the applicator head. The cleaning component 15 may be easily removed from the applicator head 10 by applying outward stripping action to the cleaning component 15 so that the cleaning component 15 may be easily removed for replacement with a new cleaning pad.

Handle means is attached to one side of the applicator head 10 for manipulating the applicator head in a cleaning motion over a surface to be cleaned. The handle means is illustrated as being a molded elongate handle 25 with opposed ends. Means is provided for pivotally supporting one end of the handle 25 on the outer side 11 of the applicator head 10. The pivotal support means includes an outwardly extended and integrally molded pivot boss 26 extending outwardly from the outer side 11 of the applicator head 10. As illustrated in dotted lines in FIG. 5, the pivot boss 26 is substantially hollow and is provided with integrally molded pivot openings 27 on opposed sides thereof.

The upper end of the handle 25 is provided with an integrally molded yoke 30 and inwardly extending integrally molded pivot pins 32 which are provided on the inner portions with diverging cam surfaces 33 (FIG. 5). A bore 34 is integrally molded in the yoke 30 and extends through the pivot pins 32. The cam surfaces 33 on the pivot pins 32 are provided to aid in assembling the handle 25 to the applicator head 10. The cam surfaces 33 move the separate arms of the yoke 30 apart as the handle 25 is pressed onto the boss 26 until the pivot pins snap into position in the bores 27 of the boss 26. If desired, a pin, not shown, may be inserted through the bore 34 to maintain the yoke 34 in pivotal engagement with the pivot boss 26.

The handle 25 is preferably molded with an internal bore, indicated at 35 in dotted lines in FIG. 2 and internal screw threads 36 are preferably provided at the lower end of the handle 25 to facilitate the threaded attachment of an elongate handle, if desired. An opening or bore 37 may be integrally molded in a medial portion of the handle 25 so that the cleaning device may be supported on a nail or hanger pin or the like.

A squeegee blade 40 is supported by and extends outwardly from one side edge of the applicator head 10. The squeegee blade 40 has a thickened inner portion which is adapted to fit into a molded groove in the side edge of the applicator head 10. Stop means is provided for limiting the pivotal movement of the applicator head 10 relative to the handle 25 so that the squeegee blade 40 is in the proper angular position when the squeegee blade 40 is in engagement with the surface being cleaned, as when drying a window which has been washed, as shown in FIG. 2. The stop means includes a stop 42 which is integrally molded with the pivot support boss 26 and extends outwardly therefrom. A stop member 43 is also integrally molded with and positioned between the arms of the yoke member 30. The stop members 42, 43 engage each other (FIG. 2) to limit the pivotal movement of the applicator head 10 on the handle 25 so that the squeegee blade 40 will be at the proper angle to engage and wipe the surface which has been cleaned.

The cleaning device of the present invention thus includes a cleaning component 15 which may be easily removed and replaced on the applicator head 10. The impaling spikes 20 are positioned substantially throughout the length and width of the applicator head 10 to insure that the cleaning component 15 will be maintained in position during use. Thus, any lateral movement of the cleaning component relative to the applicator head is prevented. Also, the impaling spikes 20, with their laterally extending burrs 21, permit the cleaning element to be stripped from the applicator head for replacement. When the cleaning device is being used, the main forces applied to the cleaning component are directed inwardly and laterally and these forces tend to cause the impaling spikes 20 to work themselves further into the layer of fibers 17.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A cleaning device characterized by having an easily removable and replaceable cleaning component, said cleaning device comprising (1) a molded plastic applicator head having opposed sides, (2) handle means attached to one side of said applicator head for manipulating said applicator head in a cleaning motion over a surface to be cleaned, (3) said cleaning component being of generally the same configuration as the other side of said applicator head and including opposed sides, one side of said cleaning component including a cleaning pad, and the other side of said cleaning component including a layer of fibers adhesively secured along and extending substantially throughout said other side of said cleaning pad, and (4) male fastening means comprising a plurality of spaced-apart spikes having inner ends integrally molded with the other side of said applicator head, said spikes extending over a major portion of said other side of said applicator head and extending outwardly from said applicator head with free end portions thereon, said free end portions including attaching means for penetrating engagement with said layer of fibers when said cleaning component is pressed thereagainst to prevent lateral movement of said cleaning component relative to said applicator head during use of said cleaning device and permitting said cleaning component to be stripped from said applicator head for replacement.

2. A cleaning device according to claim 1 wherein said applicator head is rectangular and the length is about two and one-half times the width thereof.

3. A cleaning device according to claim 2 wherein said spikes are arranged in aligned rows extending longitudinally and transversely of said other side of said applicator head, and the distance between adjacent spikes in said longitudinal and transverse rows is substantially equal to the length of said spikes.

4. A cleaning device according to claim 1 wherein said spikes are each conical with the larger end being integrally molded with said other side of said applicator head, and wherein said attaching means comprises a pair of burrs integrally formed with the smaller end of each of said impaling points, said burrs extending outwardly in opposite directions from and at substantially right angles to the longitudinal axis of each of said spikes.

5. A cleaning device according to claim 3 or 4 wherein said spikes in adjacent longitudinal rows are staggered relative to each other.

6. A cleaning device according to claim 1 wherein said cleaning pad is formed of a spongelike prepolymer polyester urethane material.

7. A cleaning device according to claim 6 wherein the outer surface of said cleaning pad is provided with an irregular wafflelike configuration.

8. A cleaning device according to claim 1 including an elongate handle having opposed ends, and means pivotally supporting one end of said handle to said one side of said applicator head.

9. A cleaning device according to claim 8 wherein said applicator head is rectangular, and including a squeegee blade supported by and extending outwardly from one longer edge of said applicator head, and wherein said pivotal support means includes stop means for limiting the pivotal movement of said applicator head relative to said handle so that said squeegee blade is in the proper angular position when said squeegee blade is in engagement with the surface being cleaned.

* * * * *